US011273968B2

(12) United States Patent
Lee

(10) Patent No.: US 11,273,968 B2
(45) **Date of Patent: *Mar. 15, 2022**

(54) PACKAGING BOX FOR COOLING

(71) Applicant: Coupang Corp., Seoul (KR)

(72) Inventor: Yoon Hyung Lee, Yongin-si (KR)

(73) Assignee: Coupang Corp., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/214,645

(22) Filed: Mar. 26, 2021

(65) Prior Publication Data

US 2021/0221595 A1 Jul. 22, 2021

Related U.S. Application Data

(63) Continuation of application No. 17/010,688, filed on Sep. 2, 2020, now Pat. No. 10,988,300.

(30) Foreign Application Priority Data

Jan. 22, 2020 (KR) ..... 10-2020-0008507

(51) Int. Cl.
*B65D 81/18* (2006.01)
*B65D 5/24* (2006.01)
(Continued)

(52) U.S. Cl.
CPC ..... *B65D 81/18* (2013.01); *B65D 5/241* (2013.01); *B65D 5/46016* (2013.01);
(Continued)

(58) Field of Classification Search
CPC .... B65D 81/18; B65D 5/241; B65D 5/46016; B65D 5/48026; B65D 5/6626;
(Continued)

(56) References Cited

U.S. PATENT DOCUMENTS 6,945,450 B2 * 9/2005 Rusnock ..... B65D 71/36 229/101
9,901,153 B2 * 2/2018 Nash ..... A45C 13/30
(Continued)

FOREIGN PATENT DOCUMENTS

CN 101983161 A 3/2011
CN 204751002 U 11/2015
(Continued)

OTHER PUBLICATIONS

Office Action received in KR 10-2020-008507, dated Jun. 8, 2020.
(Continued)

*Primary Examiner* — Christopher R Demeree
(74) *Attorney, Agent, or Firm* — Knobbe, Martens, Olson & Bear, LLP

(57) ABSTRACT

Provided is a packaging cooler box for delivery, comprising a bottom portion to form a lower surface upon conversion into a box mode, a plurality of sidewall portions configured to connect with the bottom portion, a lid portion configured to connect with one of the sidewall portions, and to face said bottom portion upon conversion into the box mode, a crease portion formed along the edge of the bottom portion so that the sidewall portions can stand upright, joint portions configured to join said sidewall portions, to be folded to face itself and to be in close contact with the sidewall portions, upon conversion into the box mode, and easy adhesive portions provided in said joint portions and sidewall portions to maintain the box shape upon conversion into the box mode from a single plane consisting of said bottom portion, sidewall portions, said lid portion and joint portions.

6 Claims, 14 Drawing Sheets

(51) Int. Cl.

| | |
|---|---|
| ***B65D 5/46*** | (2006.01) |
| ***B65D 5/49*** | (2006.01) |
| ***B65D 5/66*** | (2006.01) |
| ***B65D 81/38*** | (2006.01) |

(52) U.S. Cl.
CPC ..... *B65D 5/48026* (2013.01); *B65D 5/6626* (2013.01); *B65D 81/3816* (2013.01)

(58) Field of Classification Search
CPC .. B65D 81/3816; B65D 5/3678; B65D 81/38; B65D 5/4612; B65D 57/00; Y02W 90/10
USPC ..... 229/117.23, 186, 117.01, 117.12, 138, 229/120.02, 120.04, 120.22, 120.31, 229/120.33, 120.38; 206/545; 220/592.2, 220/592.26
See application file for complete search history.

(56) References Cited

U.S. PATENT DOCUMENTS

| | | | | |
|---|---|---|---|---|
| 2003/0106895 | A1* | 6/2003 | Kalal | B65D 81/3893 220/9.2 |
| 2006/0011686 | A1 | 1/2006 | Latham | |
| 2011/0180550 | A1* | 7/2011 | Kenneally | F25D 3/125 220/592.2 |
| 2015/0344182 | A1 | 12/2015 | Malin | |
| 2020/0140179 | A1* | 5/2020 | Costanzo, Jr. | B65D 81/386 |

FOREIGN PATENT DOCUMENTS

| | | | |
|---|---|---|---|
| CN | 208544651 | U | 2/2019 |
| DE | 8502410 | U1 | 3/1985 |
| JP | S57-196676 | U | 12/1982 |
| JP | H03-090817 | U | 9/1991 |
| JP | H03-129276 | U | 12/1991 |
| JP | H04-128125 | A | 4/1992 |
| JP | H05-065820 | U | 8/1993 |
| JP | H09-169330 | A | 6/1997 |
| JP | H1035746 | | 2/1998 |
| JP | H 11-79261 | A | 3/1999 |
| JP | 2004-123100 | A | 4/2004 |
| JP | 2006-044670 | A | 2/2006 |
| JP | 2007-290763 | A | 11/2007 |
| JP | 2011-025953 | A | 2/2011 |
| KR | 10-2010-0099515 | A | 9/2010 |
| KR | 20-2013-0005820 | U | 1/2013 |
| KR | 10-2015-0108070 | A | 9/2015 |
| KR | 20150132908 | | 11/2015 |
| KR | 101601808 | B1 | 3/2016 |
| KR | 20160108694 | | 9/2016 |
| KR | 20180000809 | | 1/2018 |
| KR | 20-2019-0003179 | U | 12/2019 |
| KR | 102059779 | | 12/2019 |
| KR | 102136639 | | 7/2020 |
| WO | WO 02/32770 | A2 | 4/2002 |

OTHER PUBLICATIONS

International Search report received in PCT/KR2020/009918, dated Oct. 7, 2020.
Notice of Preliminary Rejection received in KR 10-2020-0081187, dated Nov. 4, 2020.
Decision of Patent Grant received in KR 10-2020-0081187, dated Jan. 29, 2021.

* cited by examiner

PACKAGING BOX FOR COOLING

BACKGROUND

Technical Field

This disclosure relates to a packaging cooler box.

Description of the Related Art

Recently, the online business has been flourishing, thereby bringing about a huge surge in food deliveries. For food deliveries, a packaging box is used like in any other conventional deliveries. As the food for deliveries is gradually diversified, the demand for delivery increases for foods that need to be kept refrigerated for a long time. Under the circumstances, in order to deliver such chilled food, the packaging box needs to have an insulating member attached therein, and thereby exponentially increasing the waste of resources for packaging. Further, even if a packaging box has an insulating member attached therein, the condition of the food upon receipt is frequently deteriorated due to an incomplete cooling function. Accordingly, there is a growing need for a packaging box that can replace a disposable packaging box and has an enhanced cooling function.

SUMMARY

Technical Goals

A recyclable packaging cooler box is provided. The technical problems to be solved by the embodiments of the present disclosure are not limited to the above-mentioned problems, and other technical challenges can be inferred from the following embodiments.

Technical Solutions

According to an aspect to achieve the above technical challenges, there is provided a packaging cooler box for delivery, comprising:

- a bottom portion to form a lower surface upon conversion into a box mode;
- a plurality of sidewall portions configured to connect with the bottom portion;
- a lid portion configured to connect with one of the sidewall portions, and to face said bottom portion upon conversion into the box mode;
- a crease portion formed along the edge of the bottom portion so that the sidewall portions can stand upright;
- joint portions configured to join said sidewall portions, to be folded to face itself and to be in close contact with the sidewall portions, upon conversion into the box mode; and
- easy adhesive portions provided in said joint portions and sidewall portions to maintain the box shape upon conversion into the box mode from a single plane consisting of said bottom portion, sidewall portions, said lid portion and joint portions.

According to another aspect, said crease portion has grooves formed therein spaced at predetermined intervals.

According to another aspect, said bottom portion, sidewall portions and joint portions form a single rectangular shape, upon conversion into an unfolding mode.

According to another aspect, said joint portions each have a rounded corner.

According to another aspect, said easy adhesive portions are formed symmetrically on the joint portions so that, while each of the joint portions is folded, the two opposing faces thereof can be bonded together.

According to another aspect, said easy adhesive portions are formed on said joint portions along the sides which are adjacent to the sidewall portions.

According to another aspect, said easy adhesive portions are formed along the edge of said joint portions.

According to another aspect, said easy adhesive portions are provided on the upper end of the sidewall portions which are in close contact with said joint portions.

According to another aspect, the packaging cooler box includes a compartment which is configured to be attached to the said sidewall portion, as it is rolled down, and to form a refrigerated space inside the roll.

According to another aspect, said compartment has easy adhesive portions at both ends.

According to another aspect, the two easy adhesive portions provided in said compartment are configured to be simultaneously attached to any one of easy adhesive portions formed vertically inside any one of said sidewall portions.

According to another aspect, said lid portion has flaps on which easy adhesive portions are provided, and for the conversion into a portable mode, the easy adhesive portions of said flaps are fixed to those provided in said sidewall portions.

According to another aspect, said lid portion has a handle outside.

Details of other embodiments are included in the detailed description and drawings.

Effects

The packaging cooler box of the present disclosure can be easily converted from an unfolding mode to a box mode or vice versa, and minimize the thermal losses in the vulnerable parts essentially accompanied with the conversion.

Further, a fully automated cleaning can be implemented in the packaging cooler box of the present disclosure, thereby significantly enhancing the recyclability of the packaging box.

As a result, the packaging cooler box can replace a disposable packaging box, thereby reducing the waste associated with exponentially increasing demands for delivery. In particular, the recycling of a packaging box for delivery can be achieved also for the delivery foods which require a cooling function.

The effects of the invention are not limited to those described above, and other effects not mentioned here may be clearly understood by those skilled in the art from the descriptions in the claims.

DETAILED DESCRIPTION

Figure 1:
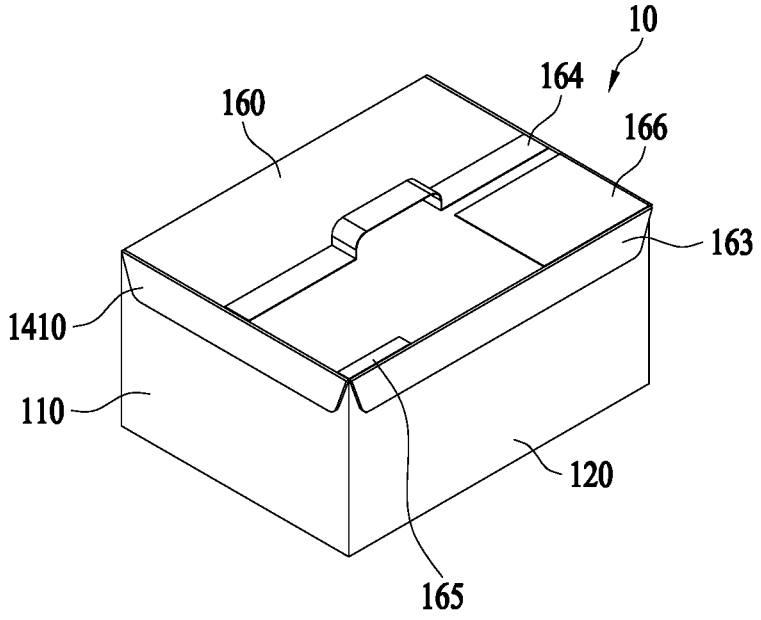
FIG. 1 is a perspective view illustrating a packaging cooler box according to an embodiment of the present disclosure.

The terms used in the embodiments are selected, as much as possible, from general terms that are widely used at present while taking into consideration the functions obtained in accordance with the present disclosure, but these terms may be replaced by other terms based on intentions of those skilled in the art, customs, emergence of new technologies, or the like. Also, in a particular case, terms that are arbitrarily selected by the applicant of the present disclosure may be used. In this case, the meanings of these terms may be described in corresponding description parts of the disclosure. Accordingly, it should be noted that the terms used herein should be construed based on practical meanings thereof and the whole content of this specification, rather than being simply construed based on names of the terms.

As used herein, the terms "module" and "portion" for the constituent elements of the present disclosure are used or interchangeably used solely for ease of preparation of the specification, and do not have different meanings and each of them does not function by itself. Further, regarding the description of the example embodiments of the present disclosure, the detailed description of the related known technologies may be omitted when such description is determined to possibly confuse the essence of the example embodiments included in the present disclosure. Further, the accompanying drawings are merely to make it easier to understand the embodiments included in the present disclosure and the technical idea of the present disclosure is not limited thereto, and they should be construed to include all of modification, equivalence and replacement involved in the idea and the technical scope of the present disclosure.

The terms including ordinal numbers such as 'first' and 'second' may be used to describe different constituent elements, which are not limited thereto. Said terms are used solely for distinguishing one element from another element.

In the entire specification, when an element is referred to as "joined with" or "connected to" another element, the two different elements may be directly joined with or connected to each other but also have another element between them. On the other hand, when an element is referred to as "directly joined with" or "directly connected to" another element, they should be understood not to have any other element between them.

As used herein, the singular forms are intended to include plural forms as well, unless the context clearly indicates otherwise.

As used herein, the term "comprising" or "having" is intended to indicate that there may be the features, numbers, steps, operations, components, parts or a combination thereof, disclosed in this disclosure, but should not be understood as excluding the case that there is one or more of other features, numbers, steps, operations, components, parts or a combination thereof, or the possibility of adding the same.

The expression "at least one of A, B, and C" may include the following meanings: A alone; B alone; C alone; both A and B together; both A and C together; both B and C together; and all three of A, B, and C together.

In the following description, embodiments of the present disclosure will be described in detail with reference to the drawings so that those skilled in the art can easily carry out the present disclosure. The present disclosure may be embodied in many different forms and is not limited to the embodiments described herein.

Hereinafter, example embodiments of the present disclosure will be described with reference to the drawings.

Figure 2:
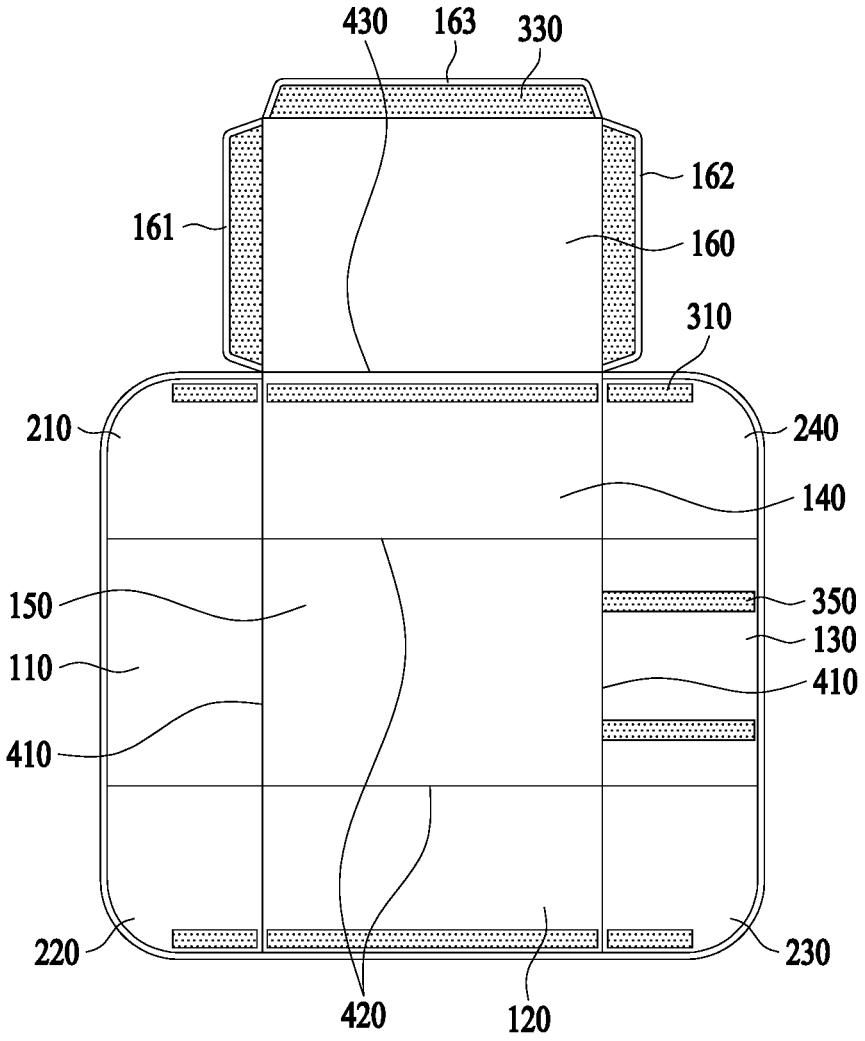
FIG. 2 is an inside view of a template for the packaging cooler box of FIG. 1.
Figure 3:
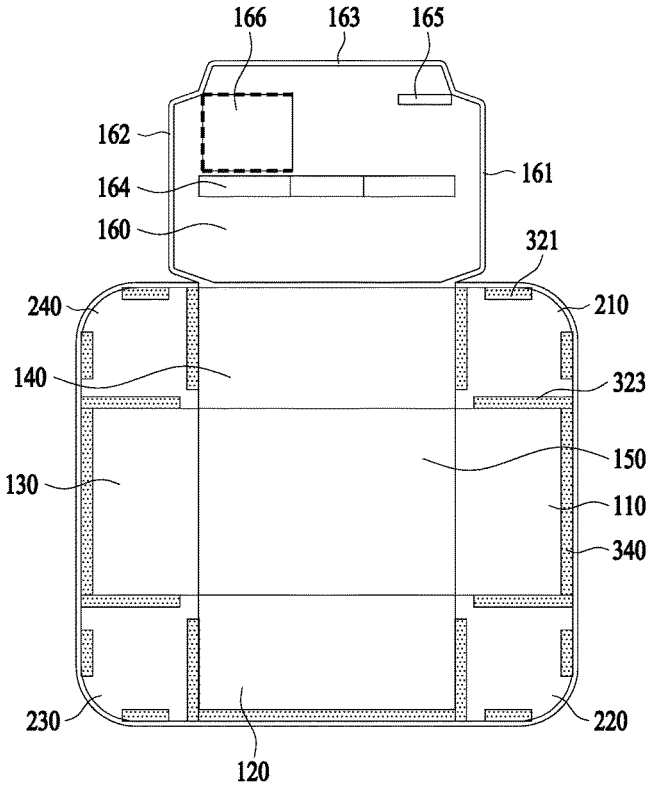
FIG. 3 is an outside view of a template for the packaging cooler box of FIG. 1.

FIG. 1 is a perspective view of a packaging cooler box according to an embodiment of the present disclosure; FIG. 2 is an inside view of a template for the packaging cooler box; and FIG. 3 is an outside view of a template for the packaging cooler box.

Referring to the above drawings, a packaging cooler box 10 of the present disclosure has a first sidewall portion 110, a second sidewall portion 120, a third sidewall portion 130, and a fourth sidewall portion 140, a bottom portion 150 which is formed to connect with the sidewall portions 110, 120, 130, 140 and forms a lower surface of the packaging cooler box 10 upon assembly into a box mode, and a lid portion 160 which is formed to connect with the fourth sidewall portion 140 and forms an upper surface of the packaging cooler box 10 upon assembly into a box mode. The lid portion 160 faces the bottom portion 150 upon assembly into a box mode.

The first sidewall portion 110 is disposed to face the third sidewall portion 130 upon assembly into a box mode, and the second sidewall portion 120 is disposed to face the fourth sidewall portion 140 that is connected with the lid portion 160 upon assembly into a box mode. Also, the second side portion 120 is disposed to be adjacent to the first sidewall portion 110 and the third sidewall portion 130 upon assembly into a box mode. The fourth sidewall portion 140 is disposed to be adjacent to the first sidewall portion 110 and the third sidewall portion 130 upon assembly into a box mode.

As the sidewall portions 110, 120, 130, 140, the bottom portion 150, and the lid portion 160 are configured to be connected in this way, it is easier to convert the packaging cooler box from an unfolding mode with the box unfolded into a box mode. In the box mode, a space to contain food may be provided therein.

The lid portion 160 may further have flaps 161, 162, 163. The flaps 161, 162, 163 may be formed to continue along the remaining sides of the lid portion 160 except for the side connecting with the fourth sidewall portion 140. An easy adhesive portion 300 may be provided on at least one of the flaps 161, 162, 163. The arrangement and shape of the easy adhesive portion 300 will be described in detail below.

Joint portions 200 are provided between the side portions 110, 120, 130, 140. The joint portions 200 are provided between any two adjacent sidewall portions of the above sidewall portions. The joint portions 200 may be configured to connect with any two adjacent sidewall portions of the above sidewall portions in an unfolding mode. The joint portions 200 may be configured to connect integrally with adjacent sides constituting two adjacent sidewall portions of the above sidewall portions in the unfolding mode.

Specifically, a first joint portion 210 may be configured to connect integrally with adjacent sides each included in the first sidewall portion 110 and the fourth sidewall portion 140. A second joint portion 220 may be configured to connect integrally with adjacent sides each included in the first sidewall portion 110 and the second sidewall portion 120. A third joint portion 230 may be configured to connect integrally with adjacent sides each included in the third sidewall portion 130 and the second sidewall portion 120. And a fourth joint portion 240 may be formed to connect integrally with adjacent sides each constituting the third sidewall portion 130 and the fourth sidewall portion 140.

Specific structures and functions of the joint portions 200 will be described in detail below.

Referring to FIG. 2, a crease portion 400 may be provided at the places where the bottom portion 150 meets the sidewall portions 110, 120, 130, 140 of the packaging cooler box 10 of the present disclosure.

A first crease portion 410 may be provided at the place where the bottom portion 150 meets the first sidewall portion 110 or the third sidewall portion 130. A second crease portion 420 may be provided at the place where the bottom portion 150 meets the second sidewall portion 120 or the fourth sidewall portion 140. The first crease portion 410 and the second crease portion 420 may be formed to connect with each other, surrounding the edge of the bottom portion 150.

A third crease portion 430 may be provided at the place where the lid portion 160 and the fourth sidewall portion 140 meet. The second crease portion 420 and the third crease portion 430 may be formed in parallel at the places where the bottom portion 150 and the lid portion 160 meet the fourth sidewall portion 140.

Specific structures and functions of the crease portion 400 will be described in detail below.

Referring to FIGS. 2 and 3, the packaging cooler box 10 of the present disclosure includes an easy adhesive portion 300.

Here, an easy adhesive portion 300 refers to a member capable of being attached and detached repeatedly for the binding purpose. The easy adhesive portion uses a binding method by which a surface meets another surface to be attached to or detached from each other. In an embodiment, the easy adhesive portion may include Velcro.

Specifically, upon assembly into a box mode, easy adhesive portions 310 may attach the folded joint portions 200 to the sidewall portions. The easy adhesive portion 310 provided on the first joint portion 210 or the fourth joint portion 240 functions to be attached to and detached from the easy adhesive portion 310 provided on the fourth sidewall portion 140. Also, the easy adhesive portion 310 provided on the second joint portion 220 or the third joint portion 230 functions to be attached to and detached from the easy adhesive portion 310 provided on the second sidewall portion 120.

Also, easy adhesive portions 320 may bond the opposing faces as the joint portions 200 are folded, during assembly into a box mode. The easy adhesive portions 320 provided on the first joint portion 210 to the fourth joint portion 240 function to attach and detach the faces that become opposite to each other as each joint portion is folded.

Also, during assembly into a box mode, easy adhesive portions 330, 340 may bond the lid portion 160 to the sidewall portions. The easy adhesive portions 330 may be provided on flaps 161, 162, 163 that are connected integrally with the lid portion 160. At the same time, the easy adhesive portions 340 may be formed on the upper part of the sidewall portions. The easy adhesive portions 340 may be provided on the upper part of the first sidewall portion 110, the second sidewall portion 120, and the third sidewall portion 130, each corresponding to the easy adhesive portions 330 provided on the flaps 161, 162, 163.

Figure 8:
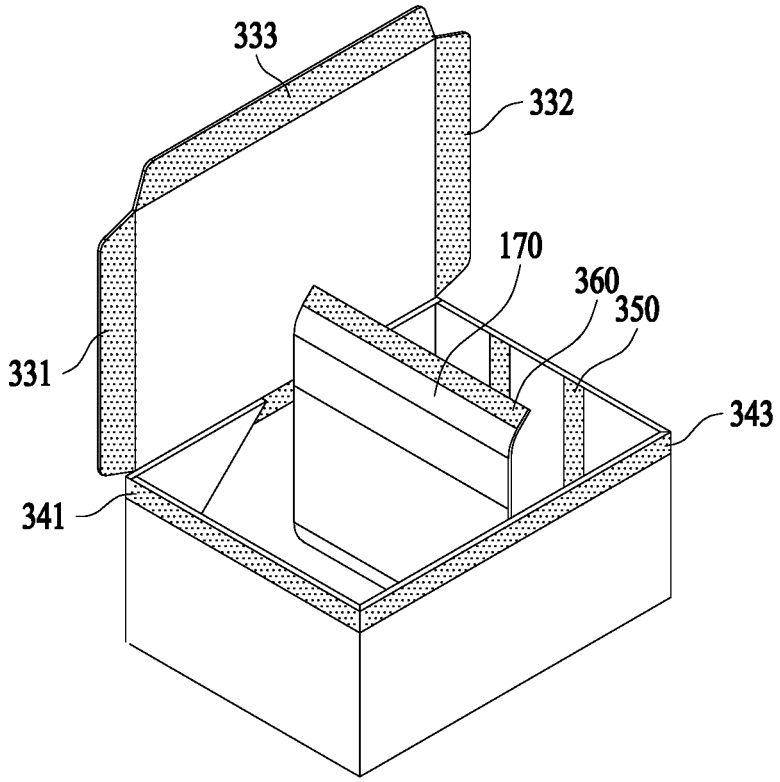
FIG. 8 is a perspective view illustrating an insertion of a compartment during the packaging cooler box of the present disclosure is assembled into the box.
Figure 9:
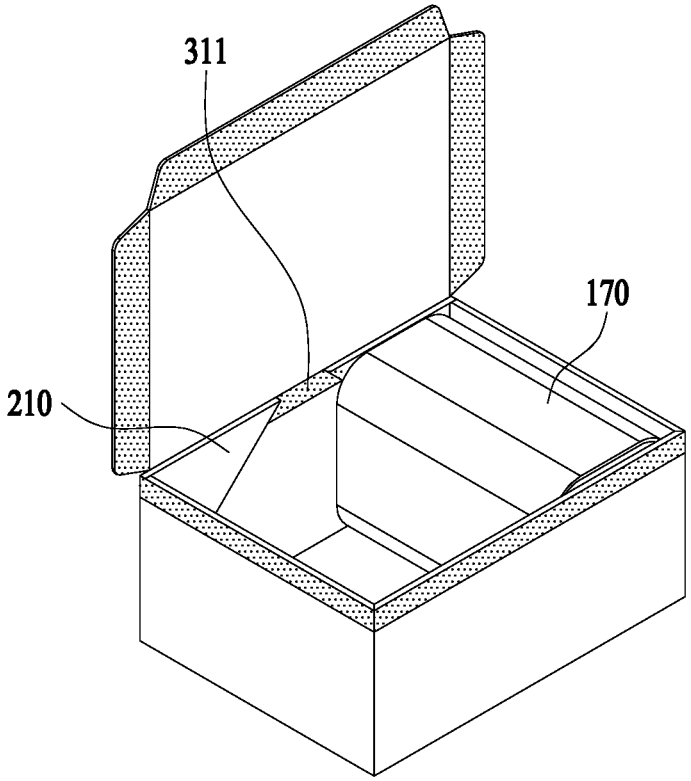
FIG. 9 is a perspective view illustrating an embodiment of a compartment which has been completely inserted during the packaging cooler box of the present disclosure is assembled into the box.

Also, easy adhesive portions 350, 360 are provided inside any one of the sidewall portions to bond a compartment 170 thereto (see FIG. 8 and FIG. 9). The easy adhesive portion 350 may be provided vertically either on the first sidewall portion 110 or on the third sidewall portion 130, and at the same time, the easy adhesive portion 360 may be provided on both ends of the compartment 170.

A specific transformation process and functions of the compartment 170 will be described in detail below.

Referring to FIG. 3, a handle 164, a label 165, and an invoice attachment 164 may be provided outside the lid portion 160.

The handle 164 is located at the center of the lid portion 160 so that, when the user pulls up the packaging box 10 in a box mode, the holding capacity applies evenly and prevents the load from sliding to one side.

The label 165 may include a bar code label having delivery information. As such, since the label 165 is provided outside the lid portion 160, it is possible to easily check information through a bar-code scanner, etc., during the delivery process in a box mode.

Also, the invoice attachment 166 may be provided so that an invoice can be inserted therein. The invoice attachment 166 is made up of a plastic pack to facilitate inserting, verifying, and removing the invoice, so that the remaining part (indicated by the dotted line in FIG. 3) other than the insert may be provided to be sewn to the lid portion 160.

According to an embodiment of FIG. 3, the label 165 may be separately provided in a different position from the invoice attachment 166. On the contrary, the label 165 may be provided to be included in the invoice attachment 166.

Figure 4:
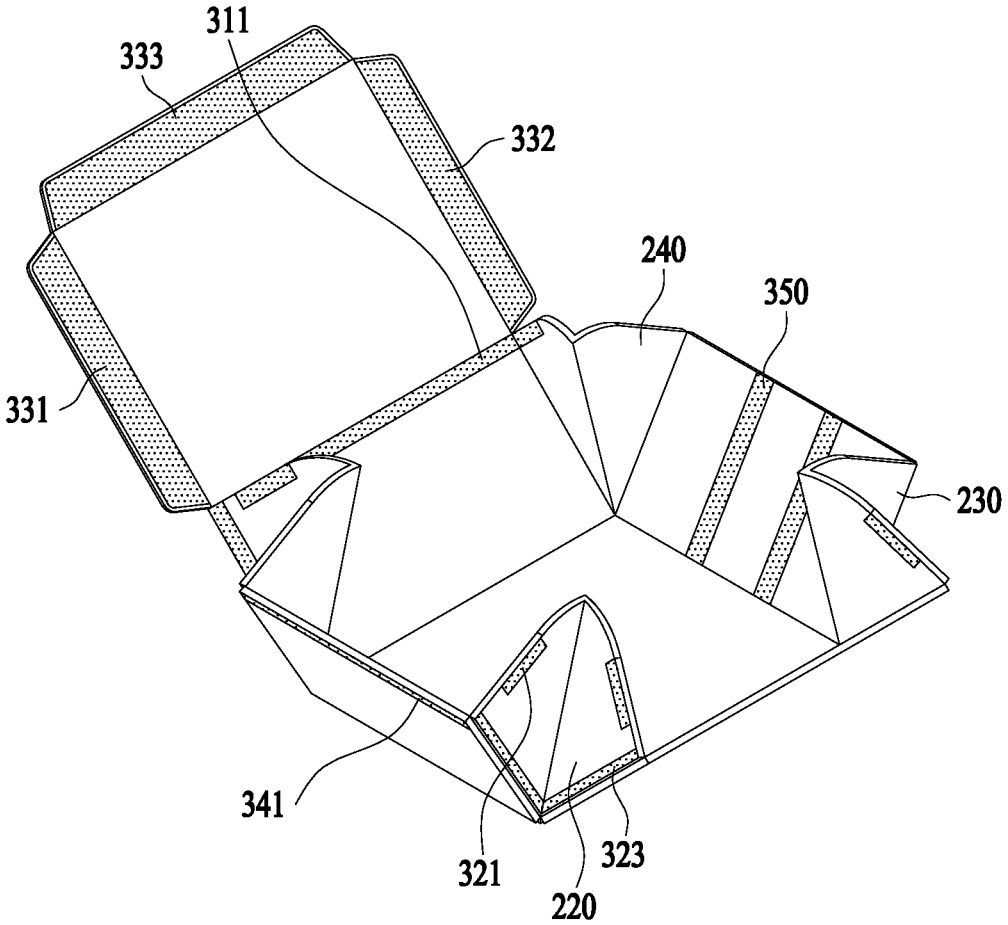
FIG. 4 is a perspective view illustrating a process of assembling the packaging cooler box of the present disclosure from an unfolding mode to a box mode.

FIG. 4 is a perspective view illustrating a process of assembling the packaging cooler box of the present disclosure from an unfolding state to a box mode.

Referring to FIG. 4, the packaging cooler box 10 may be converted from an unfolding mode with the box unfolded (see FIG. 2) to a box mode in which a space to contain food is provided therein (see FIG. 1) or vice versa.

The sidewall portions 110, 120, 130, 140, bottom portion 150 and lid portion 160, which constitute a hexahedron in the box mode, are configured to be unfolded into a single plane in the unfolding mode. The adjacent sides of the sidewall portions which are located to meet, in the box mode, become apart from each other to be spaced in the unfolding mode. The joint portions 200 are formed in these spaces, and thereby the sidewall portions 110, 120, 130, 140 joined together from the bottom portion 150 as a center may entirely form a single rectangular shape.

Specifically, said first sidewall portion 110 and said fourth sidewall portion 140 each have an adjacent side: the adjacent sides of them meet in the box mode, and become apart as the packing cooler box is converted into an unfolding mode. To join the adjacent sides thus spaced together, the first joint portion 210 is formed. The said first joint portion 210 constitutes a single plane with the first sidewall portion 110 and the fourth sidewall portion 140 in the unfolding mode. In this manner, the second joint portion 220, the third joint portion 230 and the fourth joint portion 240 can each constitute a single plane with the respective adjacent sidewall portions.

As a result, it is possible to provide such a shape that, when the packaging cooler box 10 is converted into an unfolding mode and then introduced into the cleaning device, enables a complete cleaning and minimization of obstacles in implementing cleaning automation. Advantages resulting from the cleaning device of the present disclosure will be further explained later.

On the other hand, said joint portions 200 may each have a rounded corner. For example, the first joint portion 210 is configured to be joined with the first sidewall portion 110 and the fourth sidewall portion 140, and the remaining portion of the edge thereof may be rounded. In this manner, the second joint portion 220, the third joint portion 230 and the fourth joint portion 240 are each configured to be joined with the respective adjacent sidewall portions, and the remaining portion of the edge thereof may be rounded. Therefore, the sidewall portions 110, 120, 130, 140 joined together from the bottom portion 150 as a center can integrally form a rounded single rectangular shape with the joint portions 200. Thus, the user can easily handle the packaging cooler box 10 in the unfolding mode, and the cleaning automation can be carried out smoothly.

Referring to FIG. 4, the joint portions 200 may be configured to be folded upon conversion from an unfolding mode to a box mode. In other words, the joint portions 200 may maintain the physical connection with the adjacent sidewall portions even upon conversion into the box mode. In the box mode, the place where the adjacent sides of the sidewall portions meet is vulnerable to losses due to heat leakage or heat inflow (hereinafter, collectively referred to as 'thermal losses'). The thermal losses can be effectively prevented by the joint portions 200 configured to be joined with the sidewall portions.

As such, the joint portions 200 provided in the packaging cooler box 10 of the present disclosure function so that the cleaning can be carried out smoothly through the cleaning device in the unfolding mode, and they also function, in the box mode, so that the thermal losses in the vulnerable part can be prevented to strengthen the overall cooling function.

Referring to FIG. 4, upon assembly into a box mode, a first sidewall portion 110 and a second sidewall portion 120, which were unfolded, stand upright so that the adjacent sides of each sidewall portion become closer to each other. At this time, the second joint portion 220 joined with the adjacent sides will have a diagonal crease formed therein, along which the second joint portion 220 is overlapped on itself. The second joint portion 220 as folded so as to face itself stands completely upright to be in close contact with the inside of the first sidewall portion 110 or the second sidewall portion 120. This transformation can also be performed in the first joint portion 210, the third joint portion 230 and the fourth joint portion 240 in a same manner. Further, this transformation can also be performed with the first joint portion 210, the third joint portion 230 and the fourth joint portion 240 at the same time.

In addition, as the packaging cooler box is converted from the unfolding mode into the box mode, easy adhesive portions 300 can be provided so that the joint portions 200 can be maintained in the folded position, and the folded joint portions 200 can remain close to the sidewall portions. In other words, the opposing two faces as the joint portions 200 are folded can be adhered to each other by the easy adhesive portions 300 as provided, and the folded joint portions 200 become in close contact with the sidewall portions and can be adhered thereto.

Specifically, referring to FIG. 4, the opposing two faces as the second joint portion 220 is folded can be adhered to each other by the easy adhesive portions 320 provided outside the second joint portion 220.

In an embodiment, easy adhesive portions 323 to bond the folded second joint portion 220 can be formed in the second joint portion 220 along the sides thereof adjacent to the sidewall portions to be symmetric with each other. As such, as the easy adhesive portions 323 are formed along the sides adjacent to the sidewall portions corresponding to the above-mentioned vulnerable part, it can enhance the thermal efficiency and maintain a stable box mode.

In still another embodiment, easy adhesive portions 321 can be formed along the edge of the second joint portion 220 to be symmetric with each other. Since said easy adhesive portions 323 are supplemented, the second joint portion 220 can become in close contact with the sidewall portion to keep more stable attachment thereto.

On the other hand, referring to FIG. 4, the folded fourth joint portion 240 has an easy adhesive portion 310 to be attached to the fourth sidewall portion 140. The fourth sidewall portion 140 has an easy adhesive portion 311 on the top, and the inside of the fourth joint portion 240 has an easy adhesive portion 312 corresponding thereto. In other words, the easy adhesive portion 312 is provided on the part of the inside edge of the fourth joint portion 240, with which the fourth sidewall portion 140 is in close, upon conversion into a box mode. Since the folded joint portion is adhered to the sidewall portion by said easy adhesive portion 310 in the box mode, a space to contain food can be secured in the packing cooler box, without any hindrances.

The easy adhesive portions 310, 320 having such a configuration or shape can be provided on the four joint portions 210, 220, 230, 240 in a same manner. Further, this process of the adhesion while the packaging cooler box is converted into a box mode can be carried out in the four joint portions 210, 220, 230, 240 in a same manner. As such, the four joint portions 200 located between sidewall portions have easy adhesive portions 310, 320 so that they can be folded on themselves while the packaging cooler box is converted into a box mode and remain the shape, and the folded joint portions 200 can be adhered to the inside of the sidewall portions, and thereby the thermal losses due to the gap between the sidewall portions can be reduced and the shape of the box can be securely maintained.

As such, the packaging cooler box of the present disclosure can be easily converted from an unfolding mode to a box mode or vice versa, and minimize the thermal losses in the vulnerable parts essentially accompanied with the conversion. Further, a fully automated cleaning can be implemented in the unfolding mode, thereby significantly enhancing the recyclability of the packaging box. As a result, the packaging cooler box can replace a disposable packaging box, thereby reducing the waste associated with exponentially increasing demands for delivery. In particular, the recycling of a packaging box for delivery can be achieved also for the delivery foods which require a cooling function.

Figure 5:
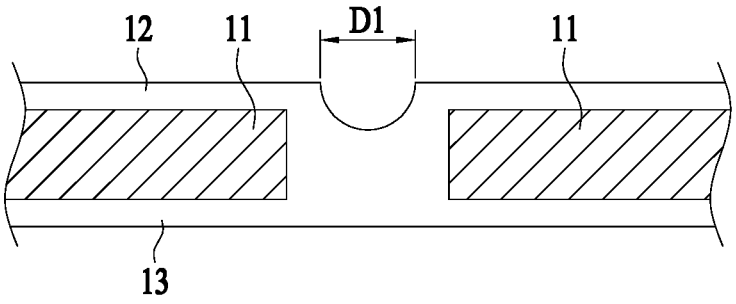
FIG. 5 is a cross-sectional view of an embodiment of a crease portion of the packaging cooler box of the present disclosure, in an unfolding mode.
Figure 6:
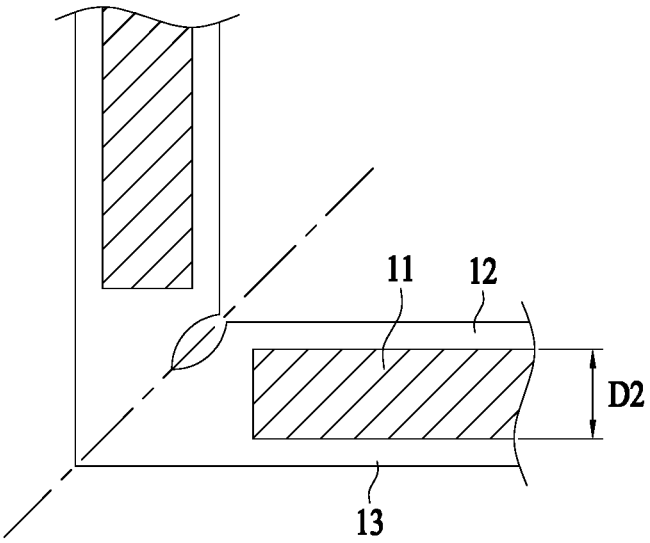
FIG. 6 is a cross-sectional view of an embodiment of a crease portion of the packaging cooler box of the present disclosure, in a folding mode.

FIG. 5 is a cross-sectional view of an embodiment of a crease portion of the packaging cooler box of the present disclosure in an unfolding mode; FIG. 6 is a cross-sectional view of an embodiment of a crease portion of the packaging cooler box of the present disclosure in a folding mode; and FIG. 7 is a cross-sectional view according to an embodiment of a sidewall portion of the packaging cooler box of the present disclosure.

Referring to the above drawings, said sidewall portions 110, 120, 130, 140, bottom portion 150 and lid portion 160, which constitute a hexahedron in the box mode, have a foam panel 11 therein. Said foam panel 11 may maintain a plate shape and be made of insulating materials for cooling, for example of expanded polypropylene (EPP).

An inner cover 12 and an outer cover 13 may be provided to contain said foam panel 11. Said inner cover 12 may be made of silver or foil for insulation or cooling. Said outer cover 13 may protect the foam panel 11 located inside, prevent from being torn due to an external cause, and be made of a tarpaulin which is waterproof.

Figure 7:
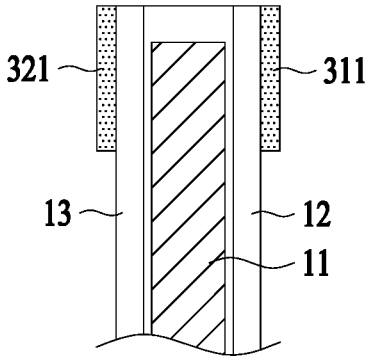
FIG. 7 is a cross-sectional view of an embodiment of a sidewall portion of the packaging cooler box of the present disclosure.

FIG. 7 illustrates a cross-sectional view of the upper part of the second sidewall portion 120 where easy adhesive portions 311, 321 are located. Referring to FIG. 7, said easy adhesive portions 311, 321, respectively, may be attached to the faces opposite to the foam panel 11 on the inner cover 12 and on the outer cover 13.

A crease portion 400 may be provided between the sidewall portions 110, 120, 130, 140 and the bottom portion 150, and between the fourth sidewall portion 140 and the lid portion 160 (FIG. 2). Referring to FIG. 5 and FIG. 6, said crease portion 400 may comprise grooves spaced at predetermined intervals (D1). The crease portion 400 having the grooves formed therein has solely the inner cover 12 and the outer cover 13 without the foam panel 11. The crease portion 400 having the grooves formed therein may be configured to have a narrower thickness than the thickness (D2) of the portion in which the foam panel 11 is contained.

The sidewall portions 110, 120, 130, 140 may easily stand upright from the bottom portion 150, and the lid portion 160 also may be easily folded from the fourth sidewall portion 140 in the process of converting into a box mode, due to the foam panels 11 being apart from each other on the said crease portion 400.

In addition, said crease portion 400 has grooves formed therein, and thereby the contaminants in the crease portion 400 may be completely eliminated when cleaning after conversion into an unfolding mode. The contamination of the bottom portion 150 is caused by a part of the food contained in the box mode but leaked therefrom. In particular, the contaminants may be hardened in the crease portions 410, 420 which are located along the edge of the bottom portion 150, and would not easily be removed even in the cleaning device. Since the crease portion 400 has grooves formed therein spaced at predetermined intervals, even when the sidewall portions 110, 120, 130, 140 stand upright from the bottom portion 150 by the conversion into a box mode, a small gap can be secured, and thus the introduced contaminants may be easily removed through the cleaning device without hardening.

Figure 10:
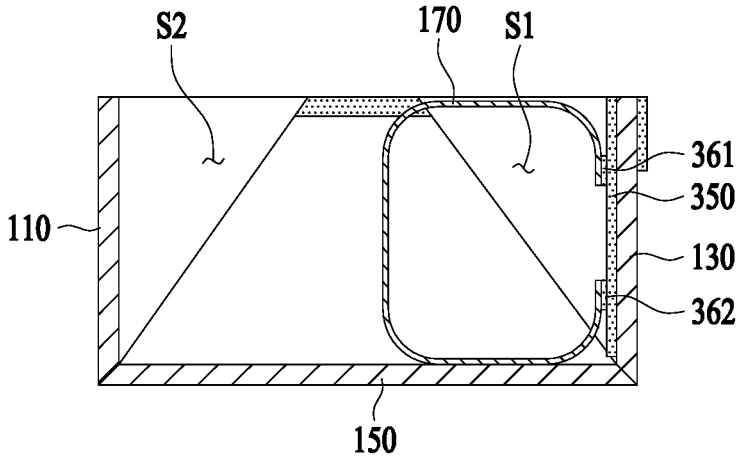
FIG. 10 is a cross-sectional view of the packaging cooler box of the present disclosure illustrating an embodiment of a compartment which has been completely inserted.

FIG. 8 is a perspective view illustrating an insertion of a compartment during the packaging cooler box of the present disclosure is assembled into a box mode; FIG. 9 is a perspective view illustrating an embodiment of a compartment which has been completely inserted; FIG. 10 is a cross-sectional view illustrating an embodiment of a compartment which has been completely inserted; and FIG. 11 is a template illustrating an embodiment of a compartment constituting the packaging cooler box of the present disclosure.

Referring to the above drawings, the packaging cooler box 10 may comprise the compartment 170 to separate the internal space in the box mode into a refrigerated space S1 and a room temperature space S2.

Figure 11:
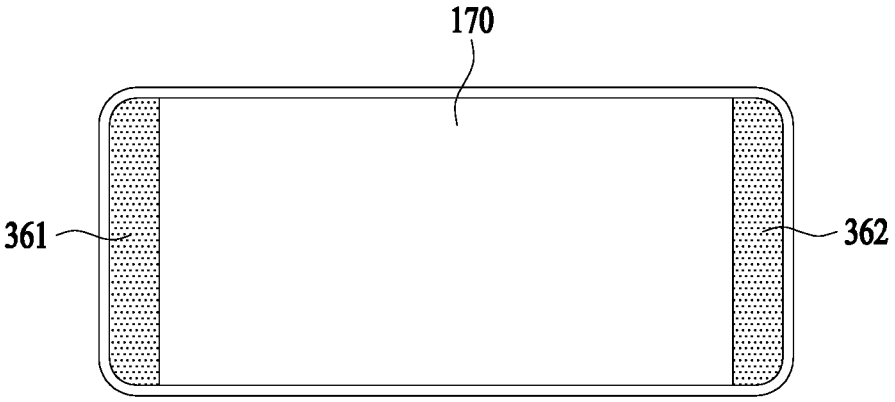
FIG. 11 is a template illustrating an embodiment of a compartment constituting the packaging cooler box of the present disclosure.

Referring to FIG. 11, said compartment 170 may consist of a single plane in the unfolded position. Said compartment 170 may have a rectangular shape, but may be formed to have rounded corners for easy handling by the user.

Said compartment 170 may have easy adhesive portions 361, 362 at both ends. Said compartment 170 may be rolled along the longitudinal direction (the transverse direction of FIG. 11). The said compartment 170 may be configured such that the easy adhesive portions 361, 362 provided at both ends thereof can contact one surface as it is rolled. As a result, a separate space is formed inside the rolled compartment 170, and the cooling power is strengthened by a dual insulation wall in the space. Therefore, an environment is provided in which this space can function as the refrigerated space S1. In other words, said refrigerated space S1 has a dual insulation wall resulting from the compartment 170 and the hexahedron of the packaging box 10, thereby preventing thermal losses such that the chilled food can be stored for a long time.

On the other hand, the space which is outside the compartment 170 but inside the hexahedron of the packaging box 10 may function as the room temperature space S2 suitable for a long-term storage of the room temperature food. By the compartment 170 provided therein, the packaging box 10 may have inside a space to store the chilled food and a space to store the room-temperature food for a long time at the optimal conditions, at the same time.

In an embodiment of the attachment of the compartment 170, referring to FIG. 10, said compartment 170 can be rolled down such that the easy adhesive portion 361 provided at one end thereof and the easy adhesive portion 362 provided at the other end can be attached to the easy adhesive portion provided in the third sidewall portion 130, at the same time.

In still another embodiment, the easy adhesive portion 361 provided at one end of the said compartment 170 can be attached to the middle part of the third sidewall portion 130, thereby forming a larger refrigerated space S1 at the lower part depending on the shape and size of the chilled food to be contained.

Further, referring to FIG. 8 and FIG. 9, during the user separates the food into the chilled food and the room-temperature food and stores them in the packaging box 10, he/she can put the chilled food first while attaching one end of the compartment 170 to the lower end of the easy adhesive portion 350, and then attach the other end of the compartment 170 to the upper end of the easy adhesive portion 350. Once the compartment 170 is completely attached, the user may put the room-temperature food in the remaining space separated by the compartment 170 to complete the storage of the contents, and right away put the lid portion 160 on, thereby rendering the condition ready to deliver. As such, the easy adhesive portions 360 provided at both ends of the compartment 170 can separate the space through a prompt, easy process and contain the food suitable for each corresponding space at the optimal conditions.

Figure 12:
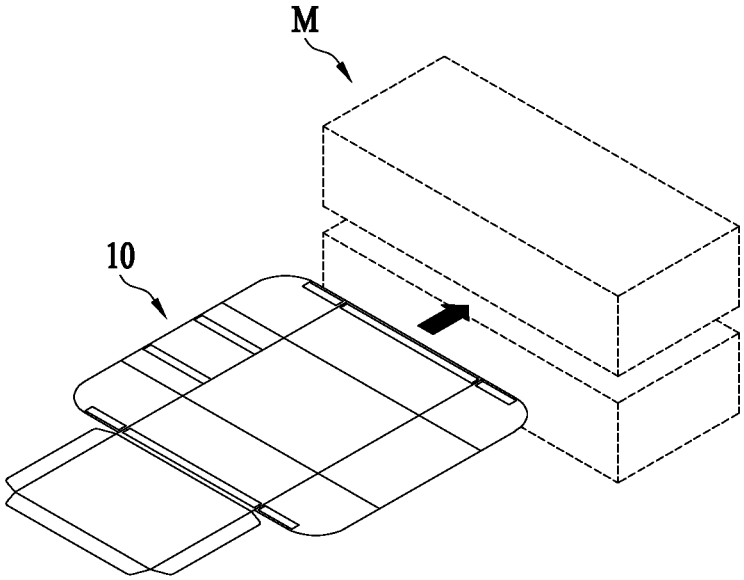
FIG. 12 illustrates cleaning of the packaging cooler box of the present disclosure.

FIG. 12 illustrates cleaning of the packaging cooler box of the present disclosure.

Referring to FIG. 12, the packaging box 10 is configured such that it can be unfolded into a single plane in the unfolding mode, and the unfolded packaging box 10 may be introduced into the cleaning device M to implement an automated cleaning.

The cleaning device M is configured such that the inside and outside surfaces of the unfolded part may be automatically cleaned as the packaging box 10 in the unfolding mode passes through the cleaning device M at a particular direction (direction of the arrow in FIG. 12). At this time, the cleaning process of the packaging box 10 may become easy and complete when the packaging box 10 is a single plane and has a simple shape such as a rectangle. In the case of a single plane with a complex shape such as a cross or a shape having protrusions, the obstacles increase in implementing an automated cleaning, such as jamming during the cleaning process.

In other words, if the joint portions 200 are not provided, and thus the adjacent sides of the sidewall portions are configured to be apart from each other in the unfolding mode of the packaging box 10, the first sidewall portion 110 and the third sidewall portion 130 would work as protrusions during they are introduced into the cleaning device M, and deteriorate the cleaning process.

As such, the packaging box 10 according to the present disclosure has the joint portions 200 joining the adjacent sidewall portions to simplify the shape in the unfolding mode into a rectangle, thereby achieving a perfect cleaning optimized to the cleaning device M.

Figure 13:
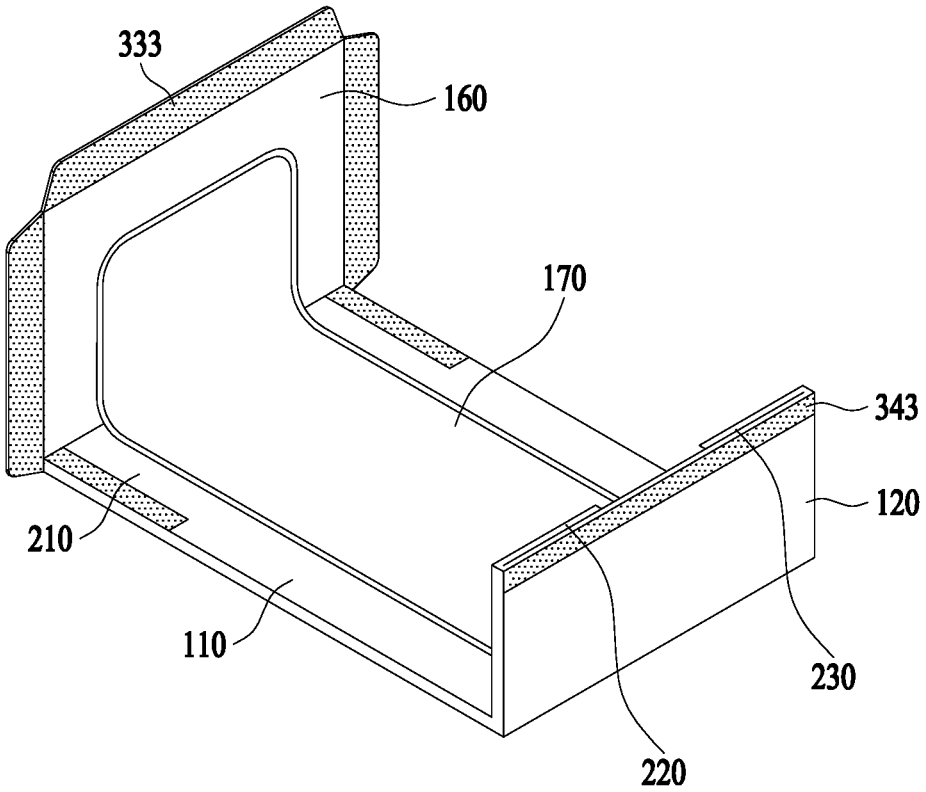
FIG. 13 is a perspective view illustrating a process of assembling the packaging cooler box of the present disclosure from an unfolding mode to a portable mode.
Figure 14:
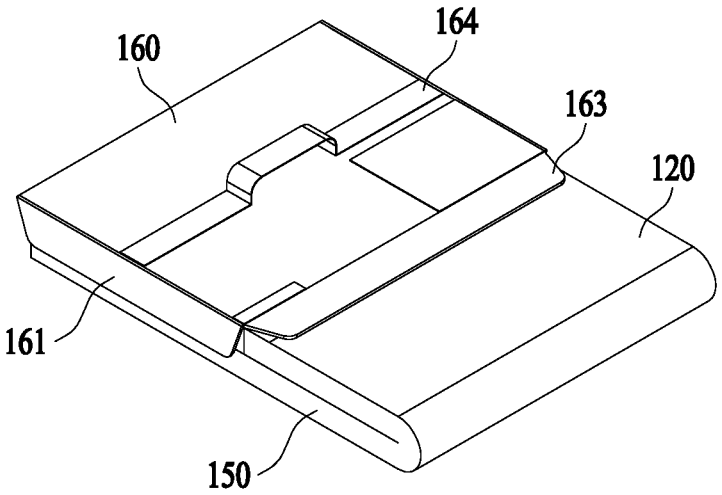
FIG. 14 illustrates the packaging cooler box which has been completely assembled into a portable mode.

FIG. 13 is a perspective view illustrating a process of assembling the packaging cooler box of the present disclosure from an unfolding mode to a portable mode; and FIG. 14 is a perspective view illustrating the packaging cooler box of the present disclosure which has been completely assembled into a portable mode.

The packaging box 10 according to the present disclosure has the joint portions 200 and the easy adhesive portions 300 in addition to the sidewall portions 110, 120, 130, 140, bottom portion 150 and lid portion 160, and thereby can be converted into the portable mode. The packaging box 10 in such a portable mode may be utilized, for example, when the delivery is completed, the content therein is removed from the packaging box 10, and then the volume and size thereof need to be minimized to be delivered back to the shipping company.

Now, the process of converting from the unfolding mode to the portable mode will be explained. First, fold the first sidewall portion 110 and the third sidewall portion 130 along with the adjacent first joint portion 210 to the fourth joint portion 240 inward. Next, put the detached compartment 170 in the place that the first sidewall portion 110, the third sidewall portion 130, etc. are folded inward. At this time, the one end of the compartment 170 may be attached to the second sidewall portion 120. Then, fold the second sidewall portion 120 inward. Then, folding the lid portion 160 inward, attach an easy adhesive portion 333 provided on the flap 163 to an adhesive portion 343 provided outside the second sidewall portion 120.

Referring to FIG. 14, the upper part of the packaging box 10 which is completely converted into the portable mode still has the handle 164 located in and exposed from the center of the lid portion 160, and thus the user can easily grasp the handle 164 to move the packaging box 10.

On the other hand, the function of fixation of the compartment 170 in the portable mode will be explained in detail as follows: the easy adhesive portion 311 can be provided on the upper end of the second sidewall portion 120 over the entire width of the second sidewall portion 120 from side to side. That is, the easy adhesive portion 311 provided on the said second sidewall portion 120 can be configured to be extended to the middle part of the second sidewall portion 120 beyond the part corresponding to the easy adhesive portions 312 provided on the third joint portion 230 and the fourth joint portion 240, which it can be attached to or separated from, or configured to be connected at the middle part.

As a result, it can be attached to the easy adhesive portion 361 provided at one end of the compartment 170 during the mode is converted into the portable mode. Although the third joint portion 230 and the fourth joint portion 240 are folded inward, a part of the easy adhesive portion 311 may be exposed in the extended middle part, and the compartment 170 may be fixed to the exposed part of the easy adhesive portion 311, and can be contained securely without falling out in the portable mode.

The above-described embodiments are merely examples and other embodiments may be implemented within the scope of the following claims.

DESCRIPTION OF THE REFERENCE NUMERALS

10: packaging cooler box
110, 120, 130, 140: sidewall portions
150: bottom portion
160: lid portion
161, 162, 163: flaps
164: handle
170: compartment
210, 220, 230, 240: joint portions
300: easy adhesive portion
S1: refrigerated space
S2: room temperature space
M: cleaning device

What is claimed is:

1. A packaging cooler box for delivery, comprising:

a bottom portion to form a lower surface upon conversion into a box mode;

a plurality of sidewall portions configured to connect with the bottom portion;

a lid portion configured to connect with one of the sidewall portions, and to face said bottom portion upon conversion into the box mode;

joint portions configured to join said sidewall portions, to be folded to face itself and to be in close contact with the sidewall portions, upon conversion into the box mode; and easy adhesive portions provided in said joint portions and sidewall portions to maintain the box shape upon conversion into the box mode, each of the easy adhesive portions configured for repeated attachment to and detachment from another one of the easy adhesive portions, wherein said bottom portion, sidewall portions, said lid portion and joint portions constitute a single plane in the unfolding mode, provided that said bottom portion, sidewall portions and joint portions form a single rectangular shape to avoid jamming when introduced into a cleaning device, and wherein said joint portions are configured to come into contact with the inside of the sidewall portions standing upright in the box mode.

2. The packaging cooler box of claim 1, wherein said joint portions each have a rounded corner.

3. The packaging cooler box of claim 1, wherein said easy adhesive portions are formed symmetrically on the joint portions so that, while each of the joint portions is folded, the two opposing faces thereof can be bonded together.

4. The packaging cooler box of claim 3, wherein said easy adhesive portions are formed on said joint portions along the sides which are adjacent to the sidewall portions.

5. The packaging cooler box of claim 4, wherein said easy adhesive portions are formed along the edge of said joint portions.

6. The packaging cooler box of claim 3, wherein said easy adhesive portions are provided on the upper end of the sidewall portions which are in close contact with said joint portions.

* * * * *